US009022797B2

(12) United States Patent
Kon et al.

(10) Patent No.: US 9,022,797 B2
(45) Date of Patent: May 5, 2015

(54) CONNECTOR AND CONNECTOR ASSEMBLY

(71) Applicant: Sumitomo Wiring Systems, Ltd., Yokkaichi, Mie (JP)

(72) Inventors: Akihiro Kon, Yokkaichi (JP); Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/761,208

(22) Filed: Feb. 7, 2013

(65) Prior Publication Data

US 2013/0237083 A1 Sep. 12, 2013

(30) Foreign Application Priority Data

Mar. 9, 2012 (JP) ..... 2012-052795

(51) Int. Cl.
*H01R 13/627* (2006.01)
*H01R 13/639* (2006.01)
*H01R 13/641* (2006.01)

(52) U.S. Cl.
CPC ..... *H01R 13/6275* (2013.01); *H01R 13/639* (2013.01); *H01R 13/6272* (2013.01); *H01R 13/641* (2013.01)

(58) Field of Classification Search
CPC ..... H01R 13/639; H01R 13/6272
USPC ..... 439/352, 382–385
See application file for complete search history.

(56) References Cited

U.S. PATENT DOCUMENTS

| | | | | |
|---|---|---|---|---|
| 6,514,099 | B2 * | 2/2003 | Endo | 439/489 |
| 6,527,579 | B2 * | 3/2003 | Sato et al. | 439/352 |
| 6,712,635 | B1 * | 3/2004 | Nimura | 439/352 |
| 6,824,417 | B1 * | 11/2004 | Nimura | 439/352 |
| 7,223,113 | B2 * | 5/2007 | Nakamura | 439/353 |
| 2002/0173197 | A1 | 11/2002 | Endo | |
| 2004/0087206 | A1 | 5/2004 | Grubbs | |

* cited by examiner

*Primary Examiner* — Felix O Figueroa
(74) *Attorney, Agent, or Firm* — Gerald E. Hespos; Michael J. Porco; Matthew T. Hespos

(57) ABSTRACT

A detector (70) movable from an initial position to a detection position is mounted on a housing main body (11). The detector (70) includes a resilient arm (72) resiliently deformable in a height direction. The resilient arm (72) contacts a lock arm (12) from behind before the housing main body (11) is connected to a mating housing (50) to prevent a forward movement at an initial position. When the housing main body (11) is properly connected to the mating housing (50), the detector (70) reaches a detection position where the resilient arm (72) enters a deformation space (25) by being pushed forward from the initial position. At the initial position, the resilient arm (72) applies a pre-load to the lock arm (12) in the height direction.

7 Claims, 20 Drawing Sheets

CONNECTOR AND CONNECTOR ASSEMBLY

BACKGROUND OF THE INVENTION

1. Field of the Invention

The invention relates to a connector and a connector assembly.

2. Description of the Related Art

U.S. Pat. No. 6,712,635 discloses a connector with a mating housing that has a lock receiving portion and a housing main body that is connectable to the mating housing. A resiliently deformable lock arm extends back from a front end part of the housing main body. A detector is mounted on the housing main body and can move from an initial position to a detection position. A resiliently deformable arm is cantilevered forward on the detector.

A front part of the resilient arm contacts the lock arm from behind before the housing main body is connected to the mating housing and holds the detector at the initial position with a forward movement thereof restricted. On the other hand, the lock arm resiliently engages the lock receiving portion when the housing main body is connected properly to the mating housing for holding the housing main body and the mating housing in a connected state. The detector is released from a movement restricted state at the initial position and is permitted to move to the detection position when the housing main body is connected properly to the mating housing. The lock receiving portion is in a deformation space for the lock arm at the detection position and a leading end of the resilient arm is inserted in a through hole in the lock arm. Thus, the detector reaches the detection position and detects that the housing main body has been connected properly to the mating housing.

The front end of the resilient arm might not contact the lock arm at the initial position due or may contact the lock arm with an improper overlap margin due to a design error or the like. An improper initial position of the detector can affect detection reliability. Obtaining a proper overlap margin between the lock arm and the resilient arm requires dimensional setting of the detector to be managed strictly and may reduce productivity.

The invention was completed in view of the above situation and an object thereof is to improve detection reliability while facilitating dimensional management of a detector.

SUMMARY OF THE INVENTION

The invention relates to a connector that has a housing main body to be connected to a mating housing. A lock arm projects from the housing main body and is resiliently deformable in a deforming direction. The lock arm can be engaged with a lock receiving portion of the mating housing to hold the housing main body and the mating housing in a connected state. A detector is mounted on the housing main body and can move from an initial position to a detection position. The detector includes a resilient arm that is resiliently deformable in the deforming direction. The resilient arm is configured: (i) to contact the lock arm before the housing main body is connected to the mating housing thereby restricting an insertion movement of the detector from the initial position, (ii) to deform into a deformation space when the housing main body is connected properly to the mating housing, thereby releasing a movement restricted state so that the detector can move from the initial position to the detection position, and (iii) to apply a pre-load to the lock arm when the detector is at the initial position.

The resilient arm is configured to apply a pre-load to the lock arm in the deforming direction when the detector is at the initial position. More particularly, the resilient arm contacts the lock arm from behind so that a proper overlap margin with the lock arm is achieved, thereby improving detection without strictly managing dimensions of the detector.

The resilient arm portion preferably is a cantilever.

A protrusion preferably is formed on the resilient arm and projects in the deforming direction for contacting the lock arm.

The detector preferably moves from the initial position toward the detection position via a standby position where the movement restricted state is released by the contact with the mating housing. The protrusion at least partly overlaps the lock arm in the deforming direction when the detector is at the standby position.

An inclined guide surface preferably is formed on the front of the protrusion. The protrusion of the resilient arm overlaps the lock arm in the deforming direction when the detector is at the standby position and the guide surface of the protrusion slides in contact with the lock arm as the detector moves from the standby position toward the detection position. The contact of the resilient arm with the lock arm in the height direction when the detector is at the initial position assures position accuracy of the protrusion.

The detector includes a main portion to be operated when the detector is to be displaced toward the detection position. The resilient arm is coupled to the main portion and resiliently deformable with a coupled position thereof as a support. The main portion slides in contact with the housing main body in the moving process of the detector.

At least one shake preventing portion preferably is provided on one of the slide-contact surfaces of the main portion and the housing main body and is squeezable against the other slide-contact surface while moving the detector toward the detection position. Thus, the detector will not shake in the deforming direction, thereby improving detection reliability of the detector. A plurality of shake preventing portions may be arranged substantially side by side in forward and backward directions and/or the deforming direction on the main portion, thereby preventing the detector from inclining in forward and backward directions and ensuring a stable posture of the detector.

The invention also is directed to a connector assembly comprising the above-described connector and a mating connector having a mating housing connectable with the housing. The mating housing preferably has a lock receiving portion engageable with the lock arm to lock the housings in the connected state.

These and other objects, features and advantages of the invention will become more apparent upon reading the following detailed description and accompanying drawings.

DETAILED DESCRIPTION OF THE PREFERRED EMBODIMENTS

A connector according to an embodiment of the invention includes a housing 10 that is connectable to a mating housing 50 and a detector 70 to be mounted on the housing 10. In the following description, ends of each housing 10, 50 that is to be connected is referred to as the front concerning forward and backward directions FBD.

Figure 11:
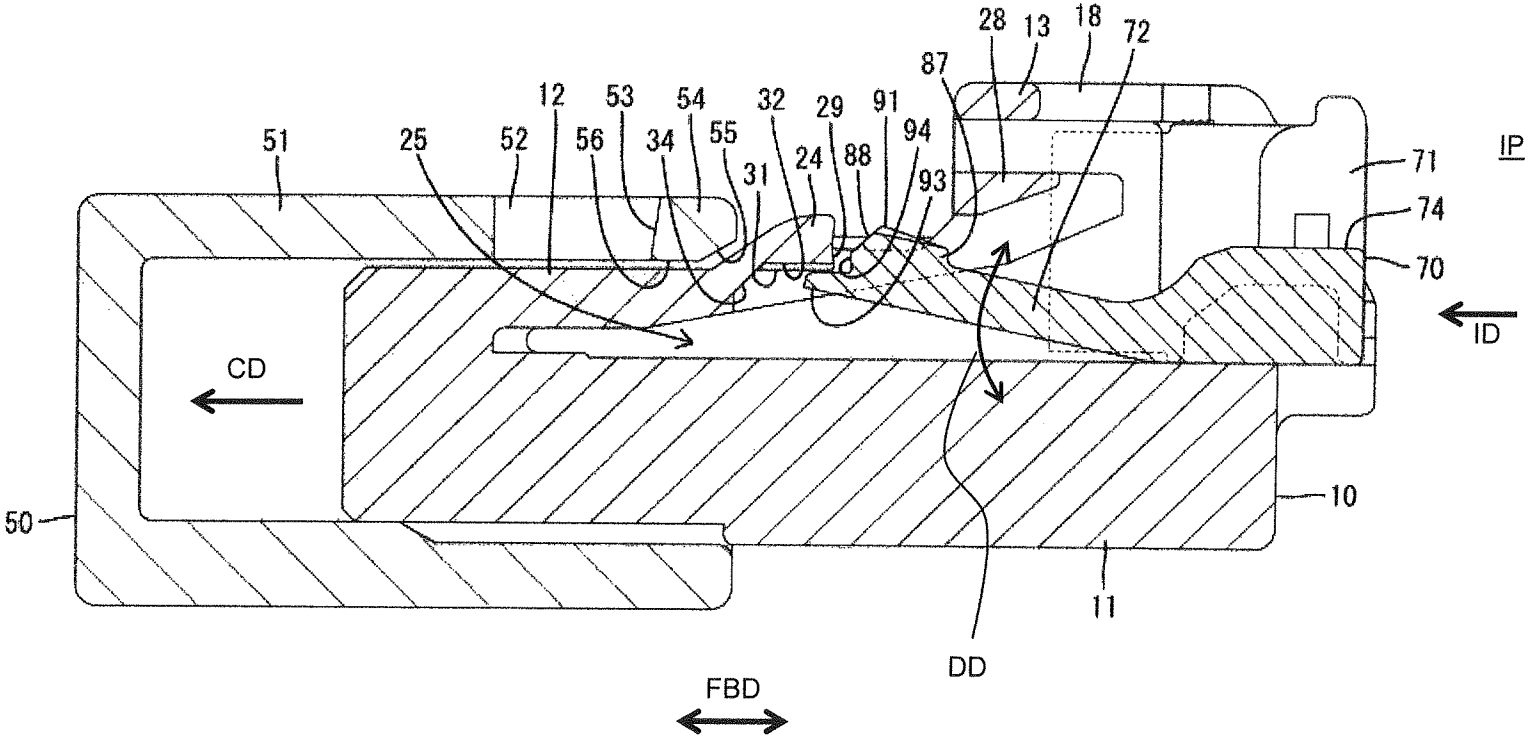
FIG. 11 is a section showing a state where the detecting member is mounted at the initial position and a housing main body is lightly connected to a mating housing.

The mating housing 50 is made e.g. of synthetic resin and has a substantially tubular receptacle 51 that opens forward, as shown in FIG. 11. A lock receiving portion 52 is formed on a front part of the upper wall of the receptacle 51. The lock receiving portion 52 penetrates through the upper wall of the receptacle 51 in a height direction HD, which intersects a connecting direction CD of the housings 10, 50. An engaging surface 53 is formed at the inner front of the lock receiving portion 52 and has a reverse taper inclined slightly forward toward an outer side. An interfering portion 54 is formed immediately before the lock receiving portion 52 at the front end of the upper wall of the receptacle 51. An inclined surface 55 is formed at a lower end of the front surface of the interfering portion 54 and inclines forward toward an outer side. A pressing surface 56 is defined on the lower side of the interfering portion 54 and extends substantially horizontally and parallel to the connecting direction CD from the inclined surface 55 to the lock receiving portion 52.

Figure 3:
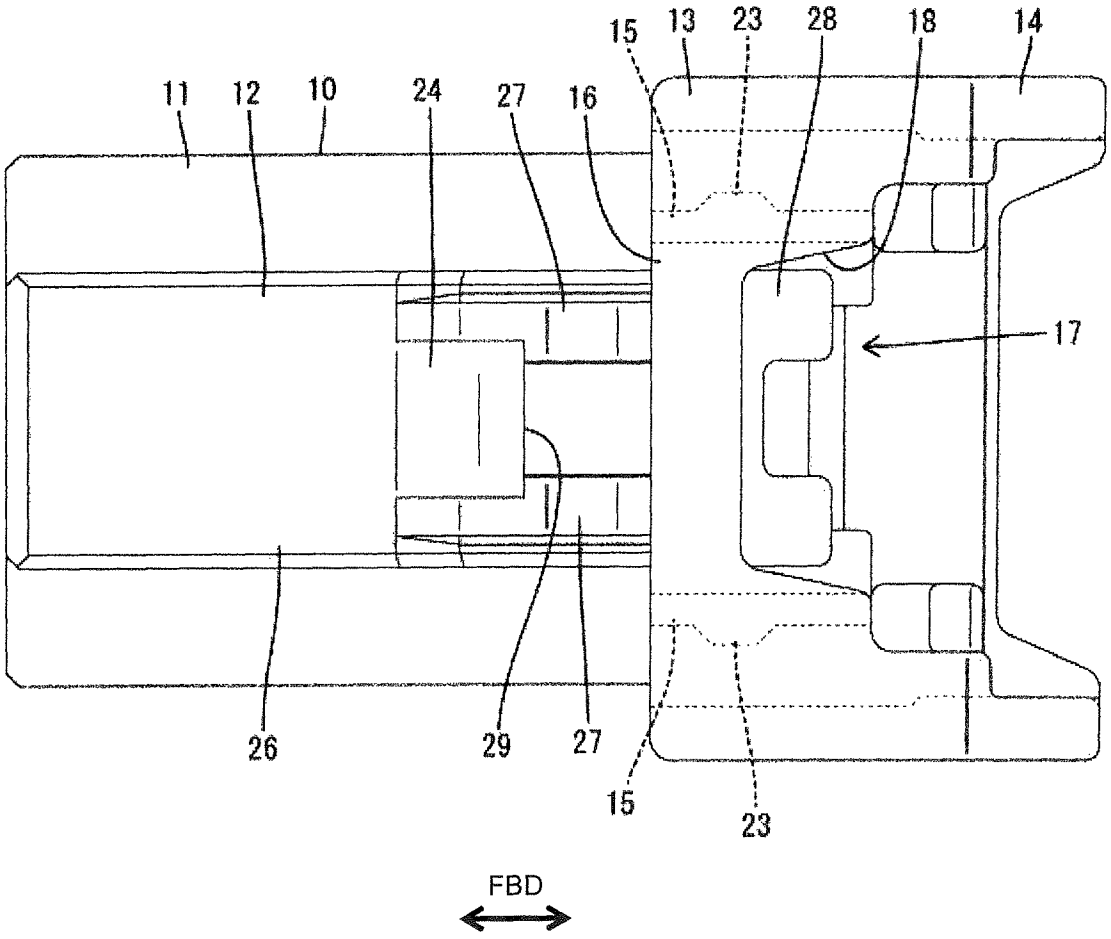
FIG. 3 is a plan view of the housing.
Figure 4:
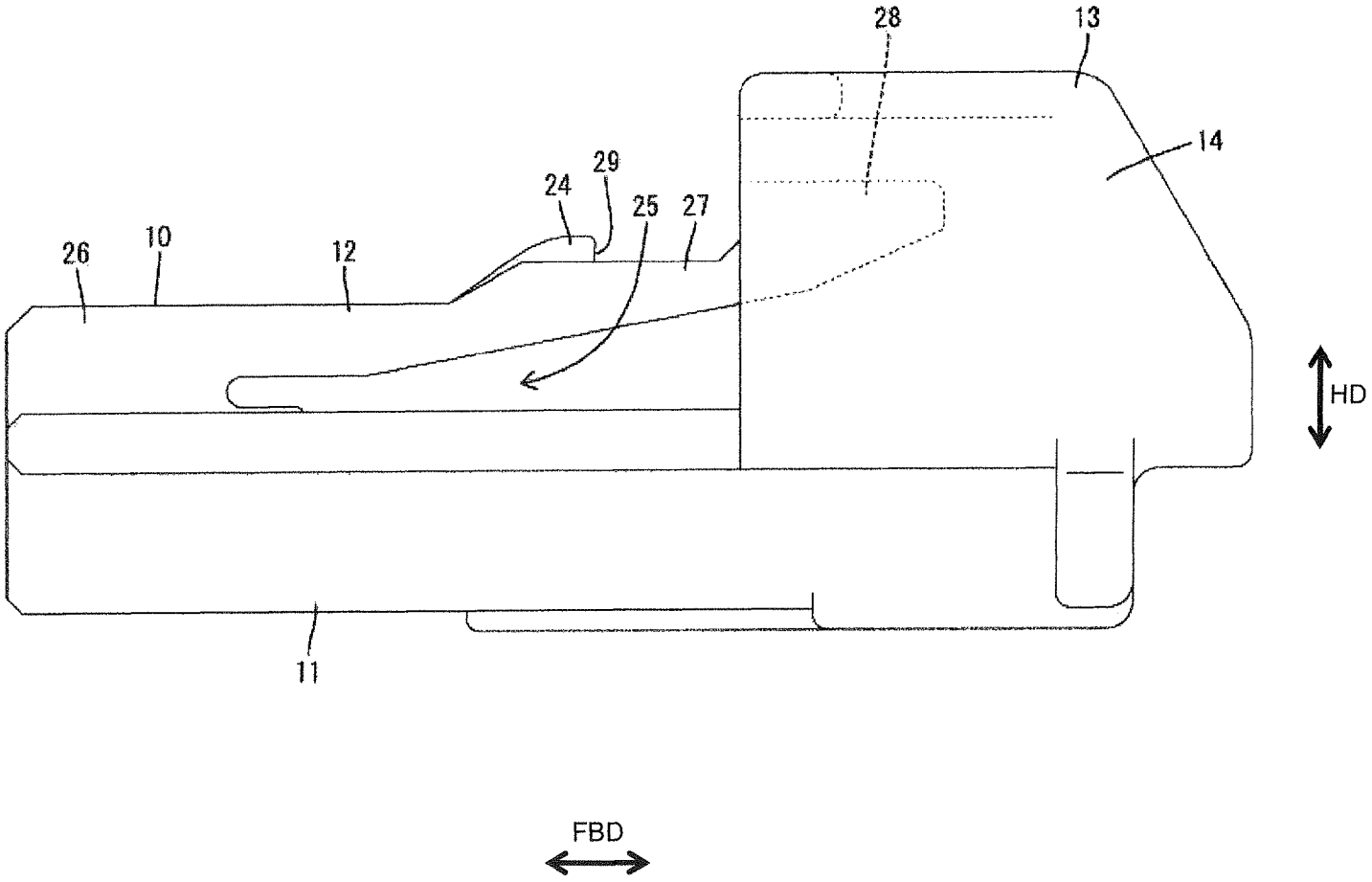
FIG. 4 is a side view of the housing.

The housing 10 is made e.g. of synthetic resin and includes a substantially block-shaped housing main body 11 and a resiliently deformable and lock arm 12 cantilevered unitarily from the upper surface of the housing main body 11, as shown in FIGS. 3 and 4. Unillustrated terminal fittings are inserted into the housing main body 11.

Figure 5:
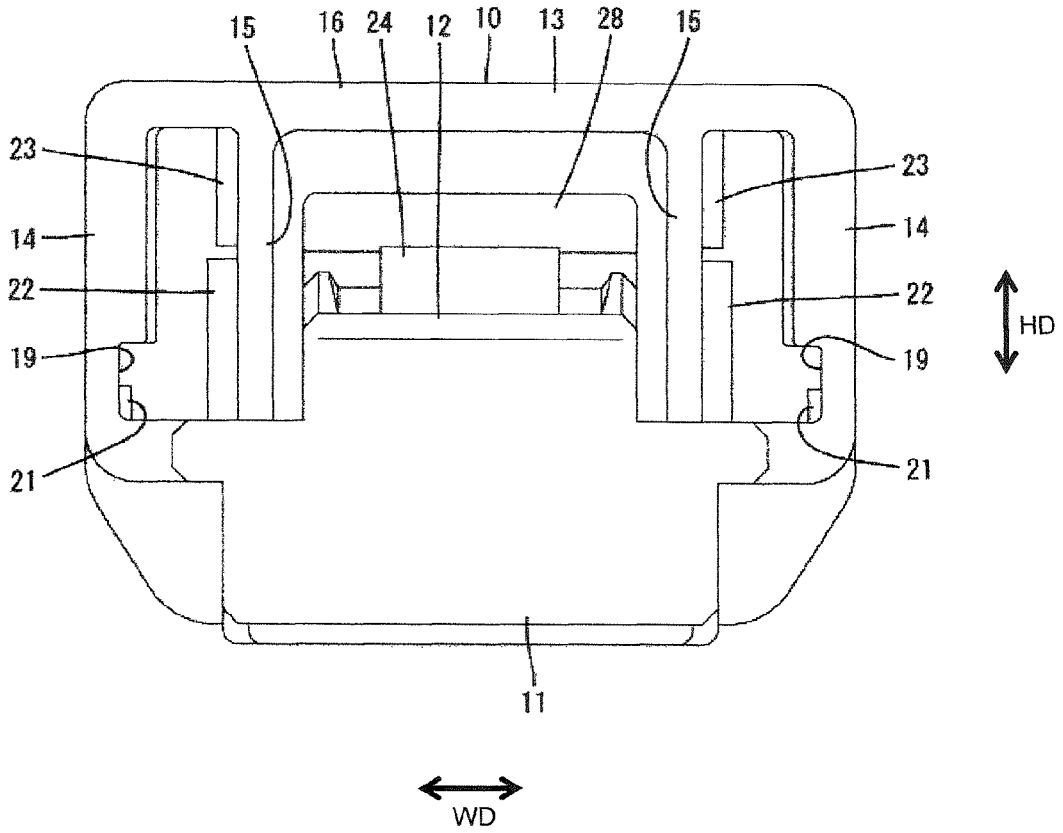
FIG. 5 is a front view of the housing.
Figure 6:
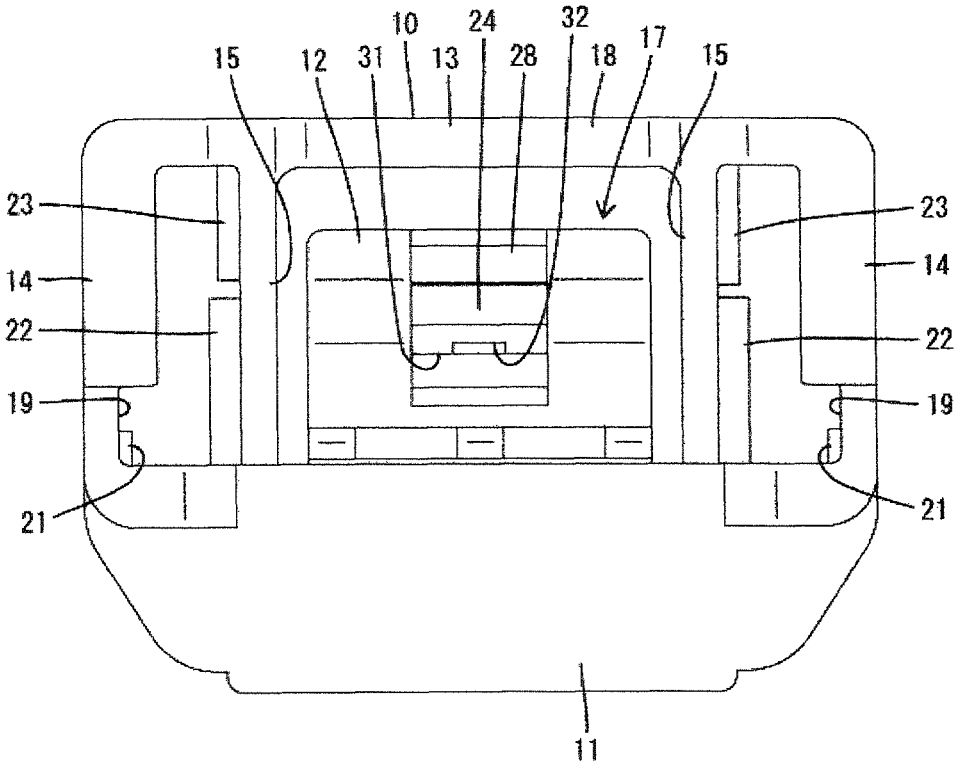
FIG. 6 is a rear view of the housing.

A substantially arch-shaped protection wall 13 is formed on the outer surface of a rear part of the housing main body 11 and surrounds a rear part of the lock arm 12, as shown in FIGS. 5 and 6. The protection wall 13 comprises two outer side walls 14, two inner side walls 15 and a covering wall 16. The outer side walls 14 project up from opposite widthwise end parts of the upper surface of the housing main body 11. The inner side walls 15 project up from the upper surface of the housing main body 11 at positions inward of the outer side walls 14. The covering wall 16 is connected to the upper ends of the inner side walls 15 and the outer side walls 14 and extends over substantially the entire width of the housing main body 11. A mount space 17 is defined inward of the protection wall 13, as shown in FIG. 19, and can receive the detector 70 inserted from behind in an insertion direction ID and parallel to the connecting direction CD.

A cut portion 18 is open on the rear end of the covering wall 16, as shown in FIG. 3, and the disengaging portion 28 of the lock arm 12 can be seen through the cut portion 18. Rear ends of the inner side walls 15 are partitioned by the cut portion 18 to be located before the rear ends of the outer side walls 14.

Figure 16:
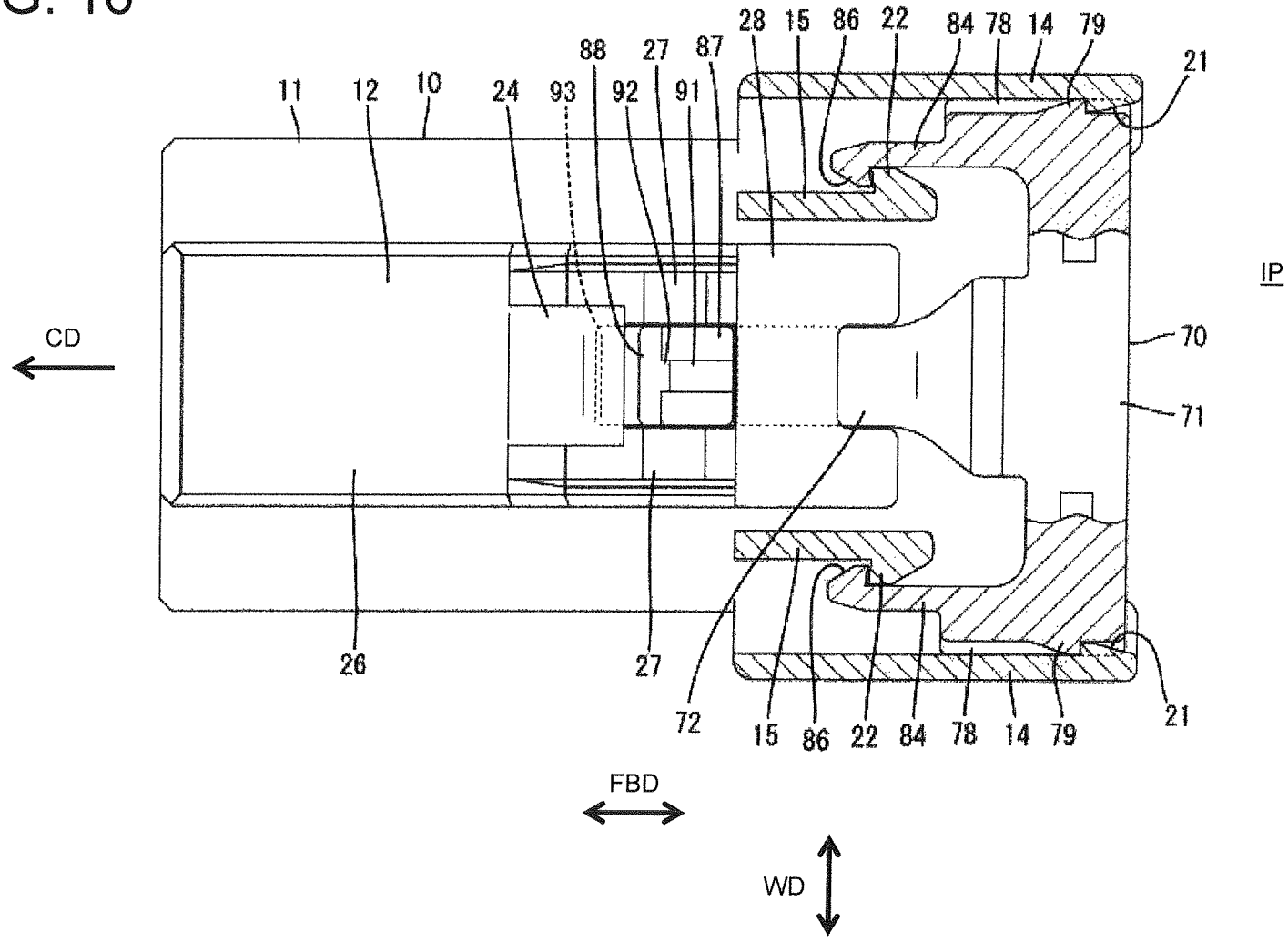
FIG. 16 is a section of an essential part showing a state where the detecting member is retained in the housing main body at the initial position.
Figure 19:
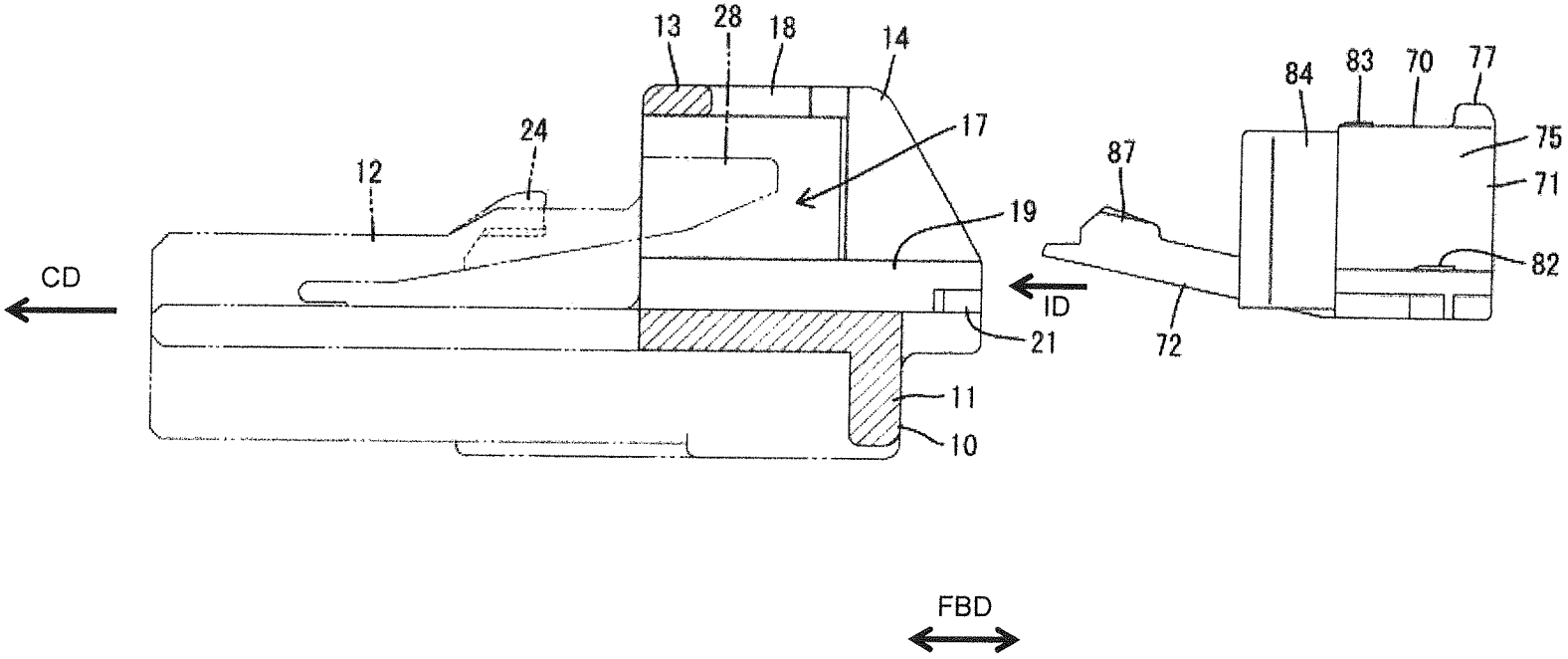
FIG. 19 is a side view with an essential part in section showing a state before the detecting member is mounted on the housing main body.

As shown in FIGS. 5 and 19, a guide groove 19 is formed on the inner surface of lower end part of each outer side walls 14. Each guide grooves 19 has a rectangular cross section, extends in forward and backward directions FBD and is open on both front and rear ends of the outer side walls 14. A first retaining portions 21 projects in on the inner surface of lower part of the rear end of each guide groove 19. As shown in FIG. 16, the rear surfaces of each first retaining portions 21 is tapered to incline in toward the front and the front surface thereof extends substantially in a width direction WD, which is perpendicular to the forward and backward directions FBD, the inserting direction ID and the connecting direction CD.

A second retaining portions 22 projects out on the outer surface of a rear end part of each inner side wall 15. As shown in FIGS. 5 and 6, each second retaining portion 22 is a long and narrow rib extending up or out in a height direction HD and substantially perpendicular to the forward and backward directions FBD and the width direction WD from the upper surface of the housing main body 11. As shown in FIG. 16, the rear surfaces of each second retaining portion 22 is tapered to incline out toward the front and the front surface thereof is reverse tapered to incline slightly forwardly toward an outer side.

Figure 17:
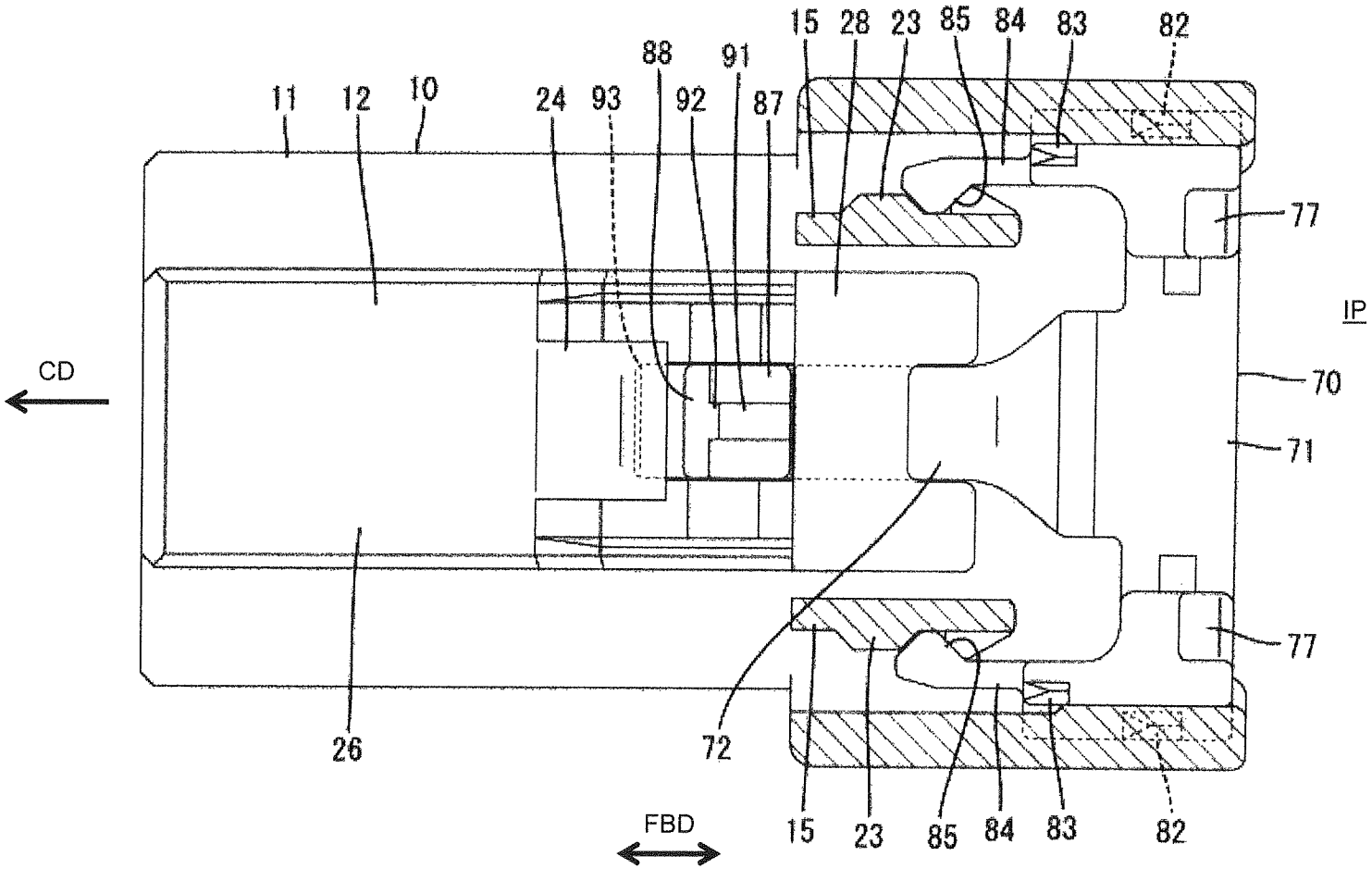
FIG. 17 is a section of an essential part showing a state where a movement of the detecting member to the detection position is prevented at the initial position.

A restricting portion 23 projects out on the outer surface of front end parts of each inner side walls 15, as shown in FIG. 17. Each restricting portion 23 is a long and narrow rib extending down in the height direction HD from the lower surface of the covering wall 16, as shown in FIGS. 5 and 6. Each restricting portion 23 has a shorter projecting distance than the second retaining portions 22, has a longer extending length than the second retaining portions 22 and is arranged above the second retaining portions 22. As shown in FIG. 17, the rear surface of each restricting portion 23 is tapered to incline out toward the front and the front surface thereof is tapered to incline in toward the front.

As shown in FIG. 4, the lock arm 12 extends back along the connecting direction CD from the upper or outer surface of a front end part of the housing main body 11. A lock projection 24 projects in the height direction HD at an intermediate part of the lock arm 12 in forward and backward directions FBD. A deformation space 25 is formed between the lower surface of the lock arm 12 and the upper surface of the housing main body 11.

As shown in FIG. 3, the lock arm 12 has a rectangular plate-shaped base end portion 26 before the lock projection 24. The front of the base end 26 is coupled to the upper surface of the housing main body 11, as shown in FIG. 4, and defines a support for resilient deformation of the lock arm 12. Two coupling beams 27 extend back from sides of the lock projection 24 and a disengaging portion 28 extends in the width direction WD and at a slightly higher position to join rear ends of the coupling beams 27, as shown in FIGS. 3 and 4. The lock projection 24 has a rearwardly facing locking surface 29, a reversely tapered upper side facing the engaging surface 53 of the lock receiving portion 52 and a slightly tapered lower side facing a movement restricting surface 94 (to be described later) of the detecting member 70, as shown in FIG. 11.

Figure 13:
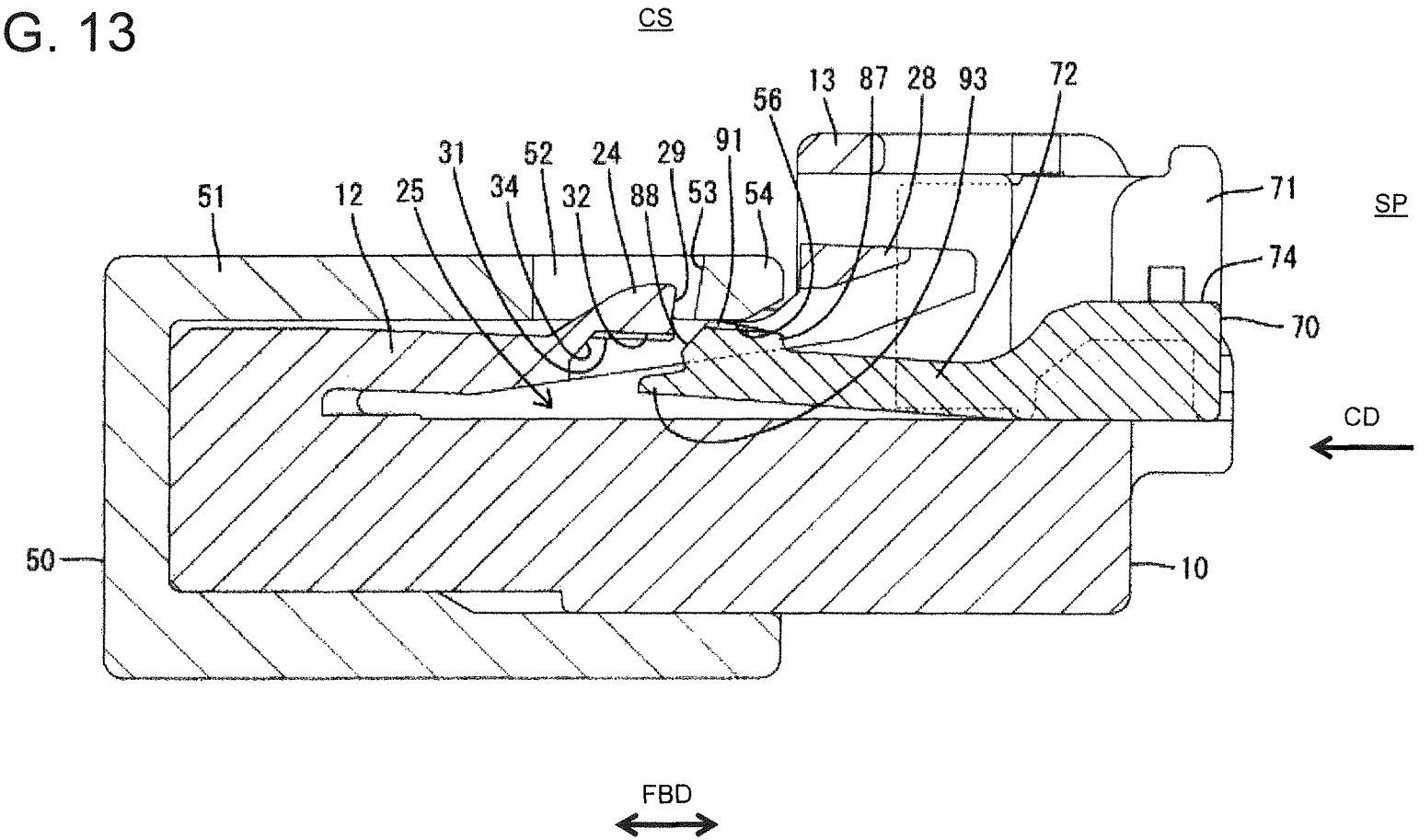
FIG. 13 is a section showing a state where the housing main body is properly connected to the mating housing, the lock arm is engaged with a lock receiving portion and the detecting member is kept at a standby position.

The lock projection 24 is urged resiliently into the lock receiving portion 52 from below when the two housings 10, 50 are connected properly, as shown in FIG. 13, so that the locking surface 29 can contact the engaging surface 53 to hold the two housings 10, 50 in a connected state CS. On the other hand, the disengaging portion 28 can be pressed from above when the two housings 10, 50 are connected properly to deform the lock arm 12 resiliently into the deformation space 25. In this way, the lock projection 24 exits the lock receiving portion 52 and the two housings 10, 50 can be separated or pulled apart.

A rearwardly open accommodating recess 31 is formed below the lock arm 12 and faces toward the deformation space 25, as shown in FIG. 11. The accommodating recess 31 is dimensioned and shaped to receive the protrusion 87 of the detector 70. The upper surface of the accommodating recess 31 is higher than the upper surface of the base end 26 of the lock arm 12. Further, an auxiliary recess 32 is formed in the upper part of the accommodating recess 31. As shown in FIG. 6, the auxiliary recess 32 is in a widthwise central part of the upper surface of the accommodating recess 31 and is less than half (particularly about ⅓) as wide as the accommodating recess 31. A depth of the auxiliary recess 32 is smaller than the depth of the accommodating recess 31.

Figure 7:
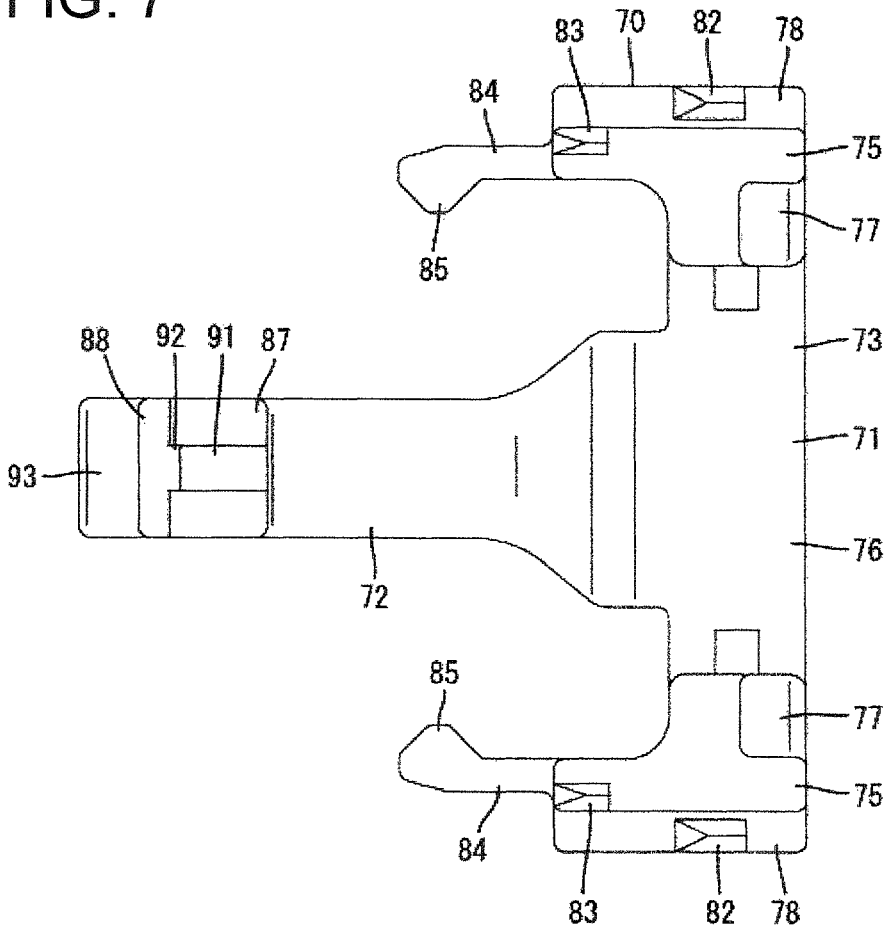
FIG. 7 is a plan view of the detecting member.
Figure 8:
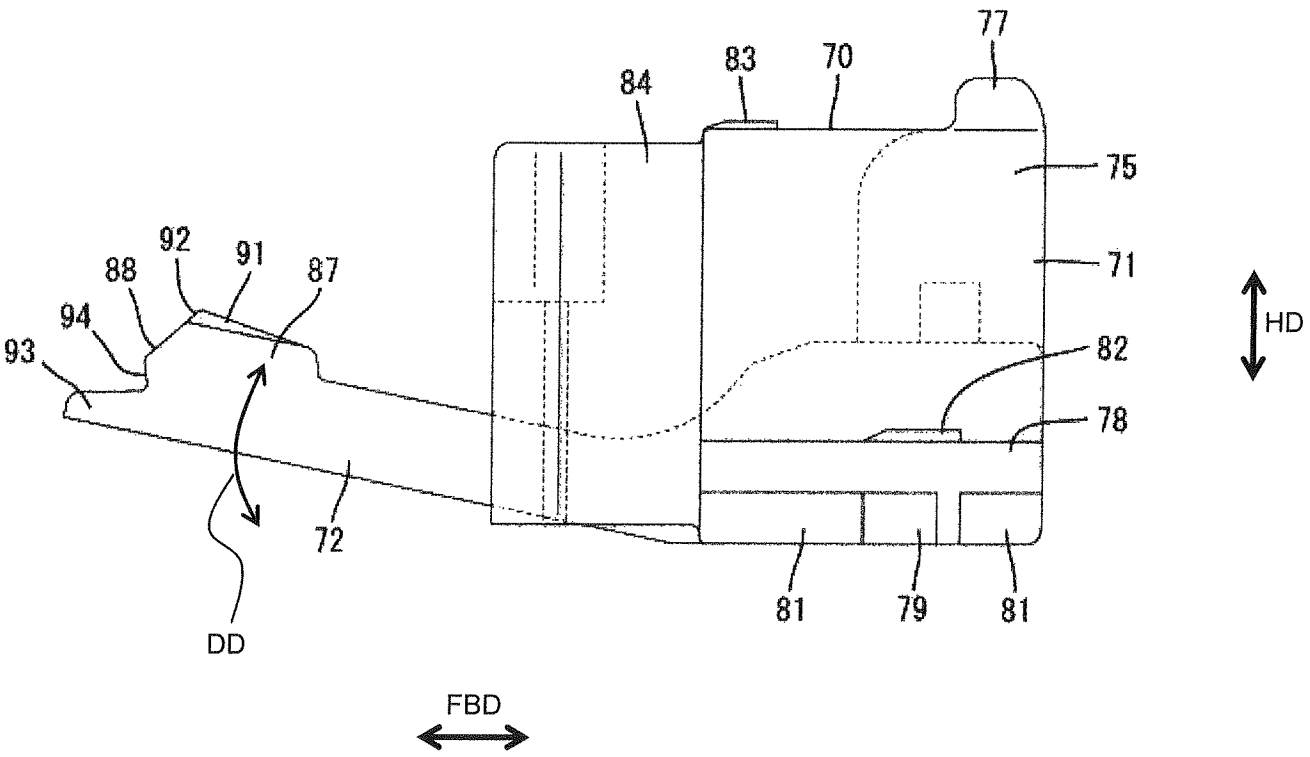
FIG. 8 is a side view of the detecting member.

The detector 70 is made e.g. of synthetic resin and includes a main portion 71 and a resilient arm 72 unitary with the front end of the main portion 71, as shown in FIGS. 7 and 8. The detector 70 is mounted in the housing main body 11 for movement from an initial position to IP a detection position DP via a standby position SP.

Figure 2:
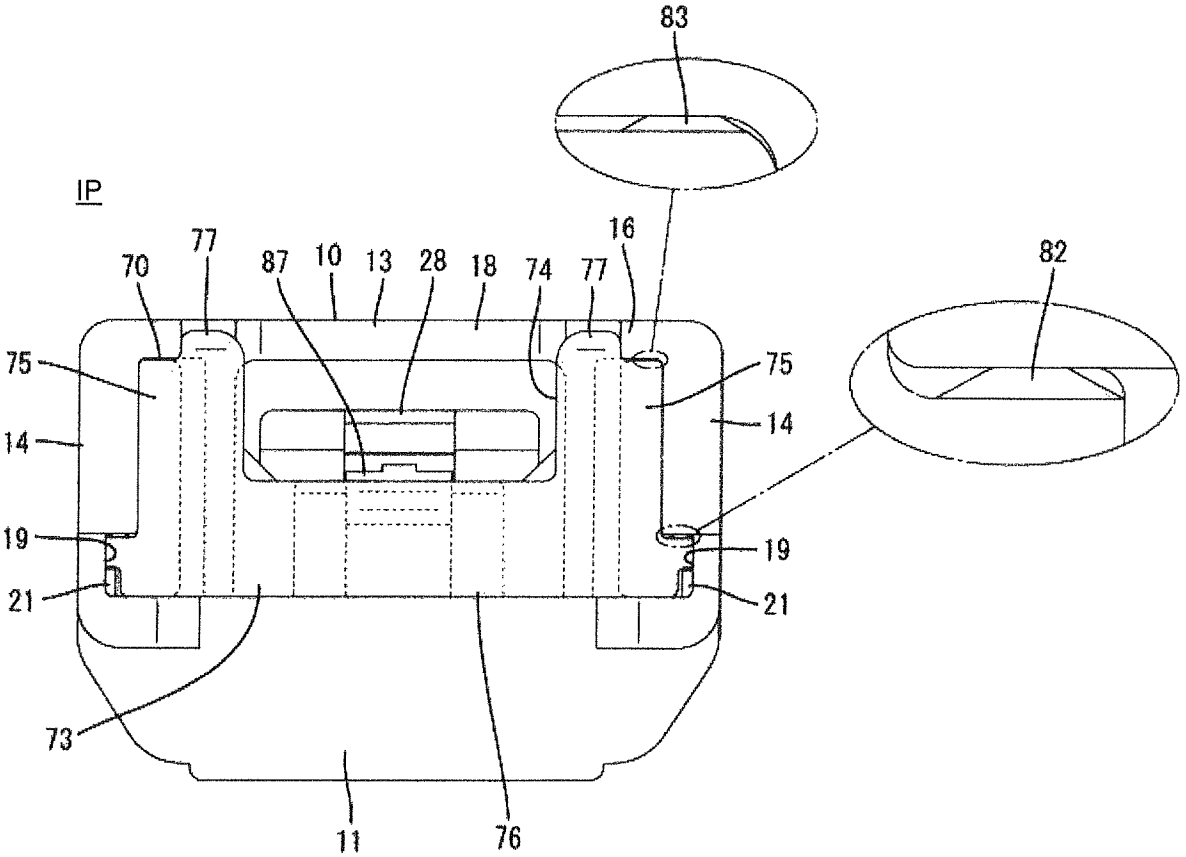
FIG. 2 is a rear view of the housing on which the detecting member is mounted at the initial position.
Figure 9:
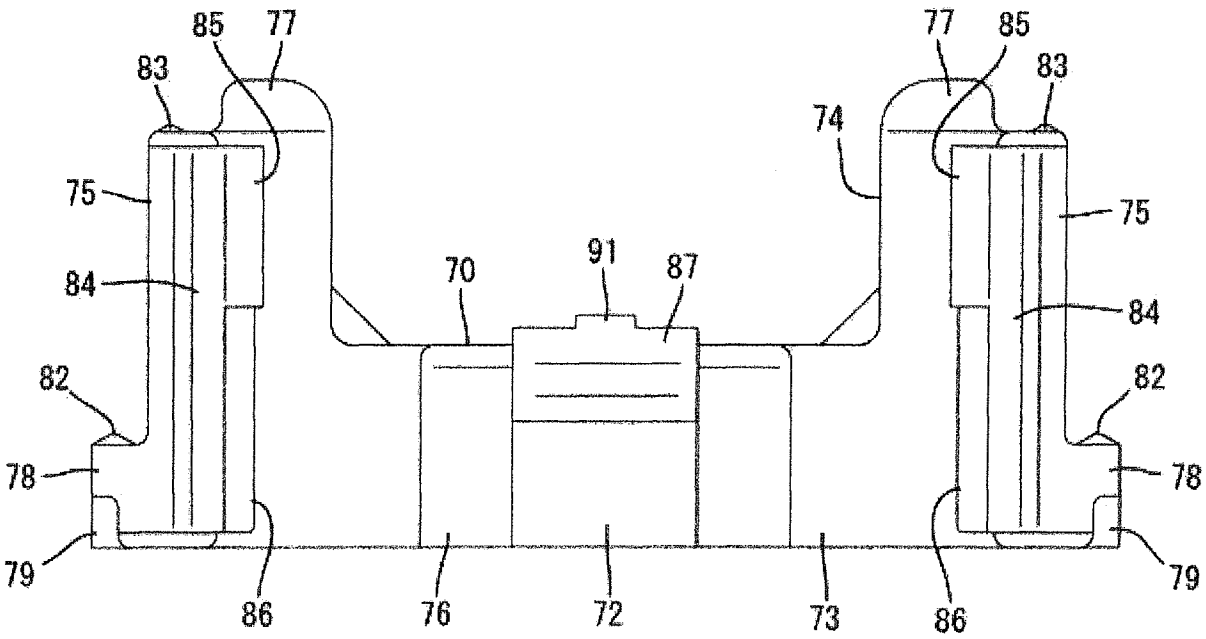
FIG. 9 is a front view of the detecting member.

The main portion 71 has a rear panel 73 extending substantially in the width direction WD and the height direction HD, as shown in FIGS. 2 and 9. The rear panel 73 is formed with a disengagement window 74 that defines a substantially U-shaped recess in a substantially widthwise central part of the upper end edge of the rear panel 73. The disengaging portion 28 of the lock arm 12 can be seen through the disengagement window 74 when the detector 70 mounted on the housing main body 11 is viewed from behind.

Two vertical walls 75 extend in the height direction HD at opposite widthwise ends of the rear panel 73 and a lateral wall 76 extends in the width direction WD to couple rear end parts of the vertical walls 75. The disengagement window 74 is partitioned by the vertical walls 75 and the lateral wall 76. The rear surfaces of the vertical walls 75 and the lateral wall 76 are arranged substantially along the height direction HD and can be pressed from behind during a movement to the detection position DP. A catch 77 projects on the upper end of each vertical wall 75. The catches 77 can be caught by fingers or a jig and a backward pulling force on the catches 77 can pull the detector 70 back from the detection position DP to the initial position IP.

Figure 10:
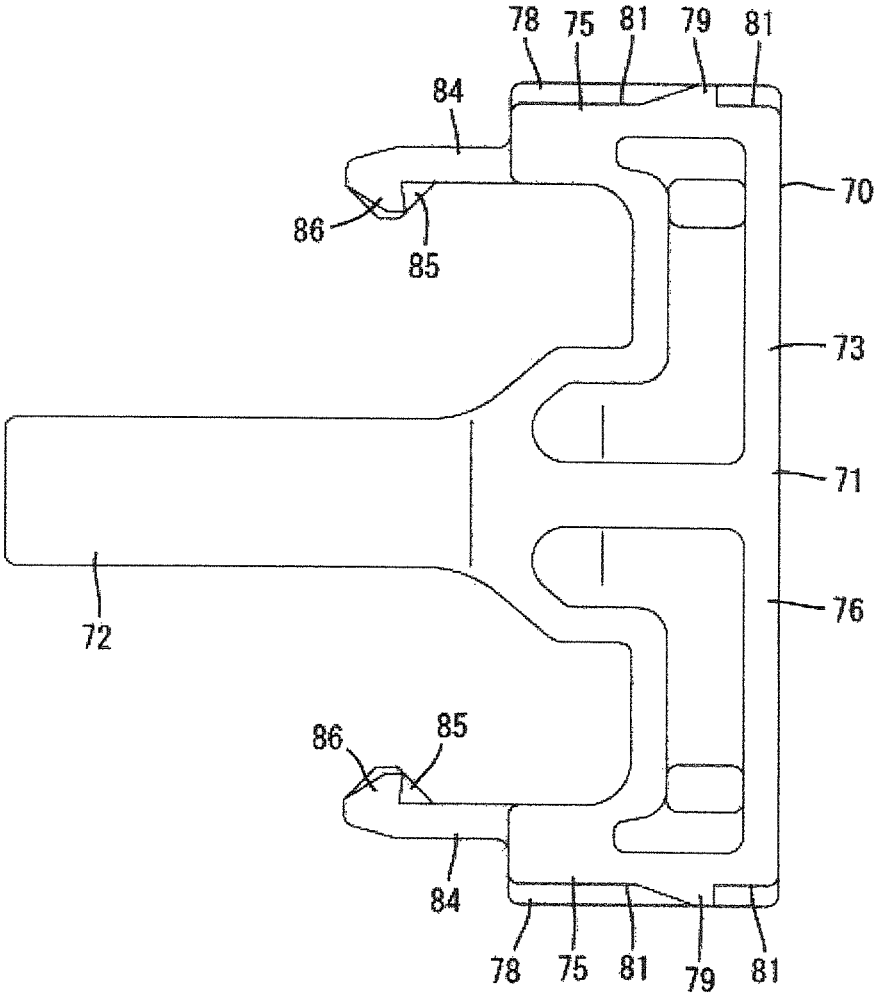
FIG. 10 is a bottom view of the detecting member.

Each vertical wall 75 is substantially rectangular in side view, as shown in FIG. 8. A guide rib 78 is formed on a lower part of the outer surface of the vertical wall 75 and extends in forward and backward directions FBD over substantially the entire length of the vertical wall 75. As shown in FIG. 10, a first stop 79 is formed on a lower part of each guide rib 78. The rear surface of each first stop 79 extends in the width direction WD. Each guide rib 78 has grooves 81 at front and rear sides of the first stop 79. The grooves 81 extend in forward and backward directions FBD and are open on both front and rear ends.

As shown in FIGS. 8 and 9, a first shake preventing projection 82 is formed on the upper surface of a rear part of each guide ribs 78 at a position to overlap the first stops 79 in forward and backward directions FBD. The first shake preventing projections 82 extend in forward and backward directions FBD at lower rear parts of opposite widthwise sides of the main portion 71 and have substantially triangular or pointed cross sections.

A second shake preventing projection 83 is formed on the upper end surface of a front part of each vertical wall 75. Each second shake preventing projection 83 is slightly smaller than the first shake preventing projection 82 and defines a rib of triangular or pointed cross section extending in forward and backward directions FBD. The second shake preventing projections 83 are adjacent upper front ends of the opposite widthwise sides of the main portion 71. In the moving process of the detector 70, the first shake preventing projections 82 are held in sliding contact with the upper surfaces of the guide grooves 19 while being squeezed and the second shake preventing projections 83 are held in sliding contact with the lower surface of the covering wall 16 while being squeezed, thereby ensuring a proper moving posture of the detector 70.

A resilient piece 84 projects forward on the front end of the vertical wall 75, as shown in FIG. 7. Each resilient piece 84 is a rectangular plate, as shown in FIG. 8, and is resiliently deformable in the width direction WD with the front end of the vertical wall 75 as a support. As shown in FIG. 9, a partial lock 85 and a second stop 86 are formed substantially side by side in the height direction HD on a front end part each resilient piece 84.

Figure 18:
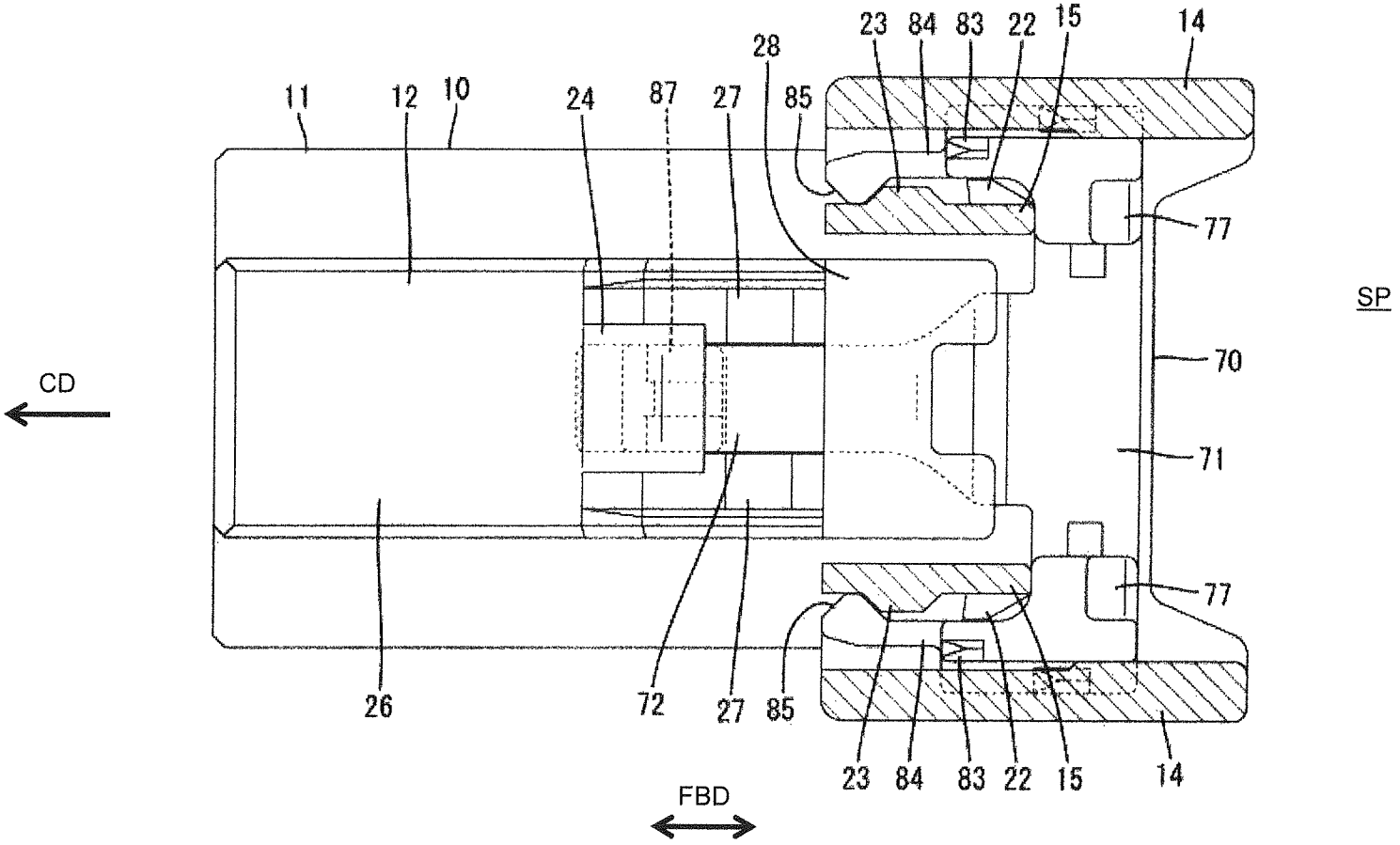
FIG. 18 is a section of an essential part showing a state where a return movement of the detecting member to the initial position is prevented at the standby position.

The partial locks 85 project in from upper halves of front parts of the resilient pieces 84 and extend in the height direction HD. As shown in FIG. 7, the rear surfaces of the partial locks 85 are tapered to incline in toward the front, and the front surfaces are tapered to incline out toward the front. As shown in FIG. 17, when the detector 70 is at the initial position IP, the front surfaces of the partial locks 85 are held in contact with the restricting portions 23 from behind in a semi-locking state to prevent movement of the detector 70 to the detection position DP. Further, as shown in FIG. 18, when the detector 70 is at the detection position DP, the rear surfaces of the partial locks 85 are in contact with the restricting portions 23 from the front in a semi-locking state to prevent a movement of the detector 70 to the initial position IP.

As shown in FIG. 9, the second stops 86 project in from lower front parts of the resilient pieces 84 and extend in the height direction HD. As shown in FIG. 10, the second stops 86 are slightly smaller than the partial locks 85. The rear surfaces of the second stops 86 are reverse tapered to incline slightly back toward an inner side. As shown in FIG. 16, when the detector 70 is at the initial position IP, the rear surfaces of the first stops 79 contact the first retaining portions 21 from the front and the rear surfaces of the second stops 86 contact the second retaining portions 22 from the front to prevent the detector 70 from being detached from or displaced within the housing main body 11.

Figure 12:
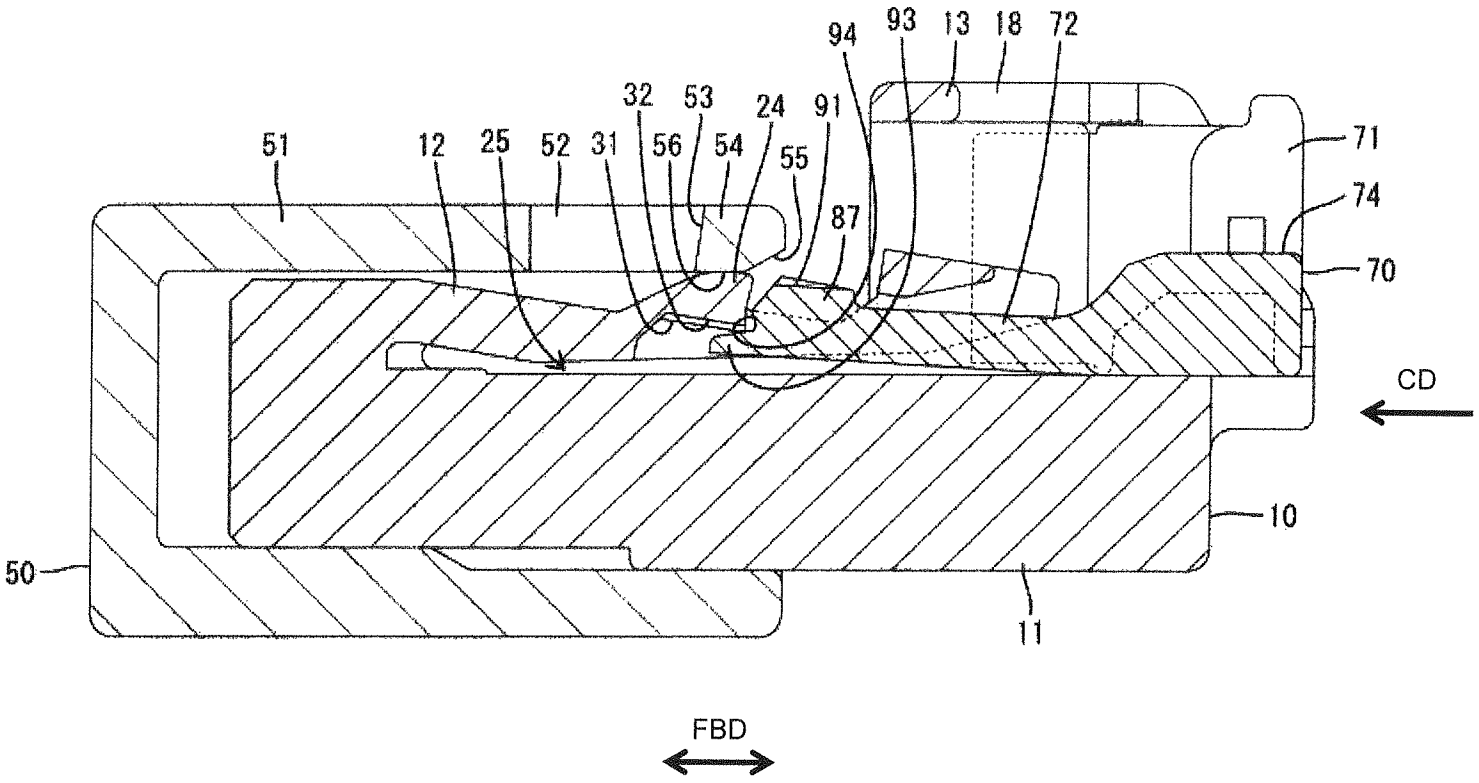
FIG. 12 is a section showing a state where the housing main body is further connected and a lock projection is pressed by a pressing surface of an interfering portion to resiliently deform a lock arm to a large extent.
Figure 15:
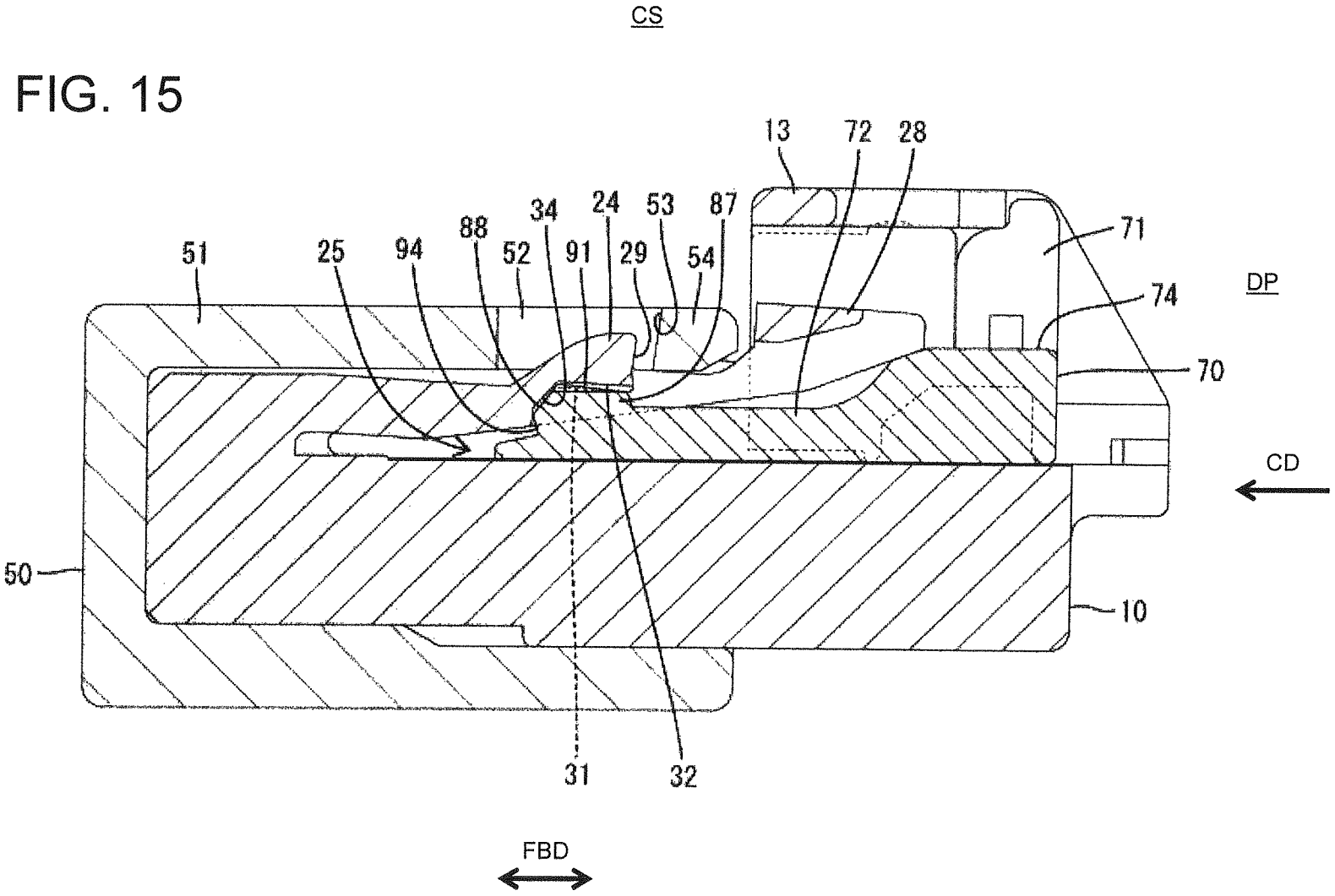
FIG. 15 is a section showing a state where the detecting member is located at the detection position and a protrusion is accommodated in the accommodating recess.

As shown in FIG. 8, the resilient arm 72 is cantilevered forward from a widthwise central part of the front of the main portion 71. The resilient arm 72 is a substantially rectangular bar and is resiliently deformable in a deforming direction DD (e.g. the height direction HD) with a rear end joined to and supported by the front of the main portion 71. The unbiased resilient arm 72 inclines up at a substantially constant angle of inclination from the rear to the front. On the other hand, as shown in FIGS. 11 to 13, the resilient arm 72 can be deformed resiliently along the deforming direction DD to gradually make its angle of inclination smaller as the detector 70 is displaced from the initial position IP to the standby position SP. The resilient arm 72 is substantially horizontal when the detector 70 reaches the detection position DP, as shown in FIG. 15. Thus, the resilient arm 72 accumulates a resilient force at the standby position SP and the detection position DP.

Figure 14:
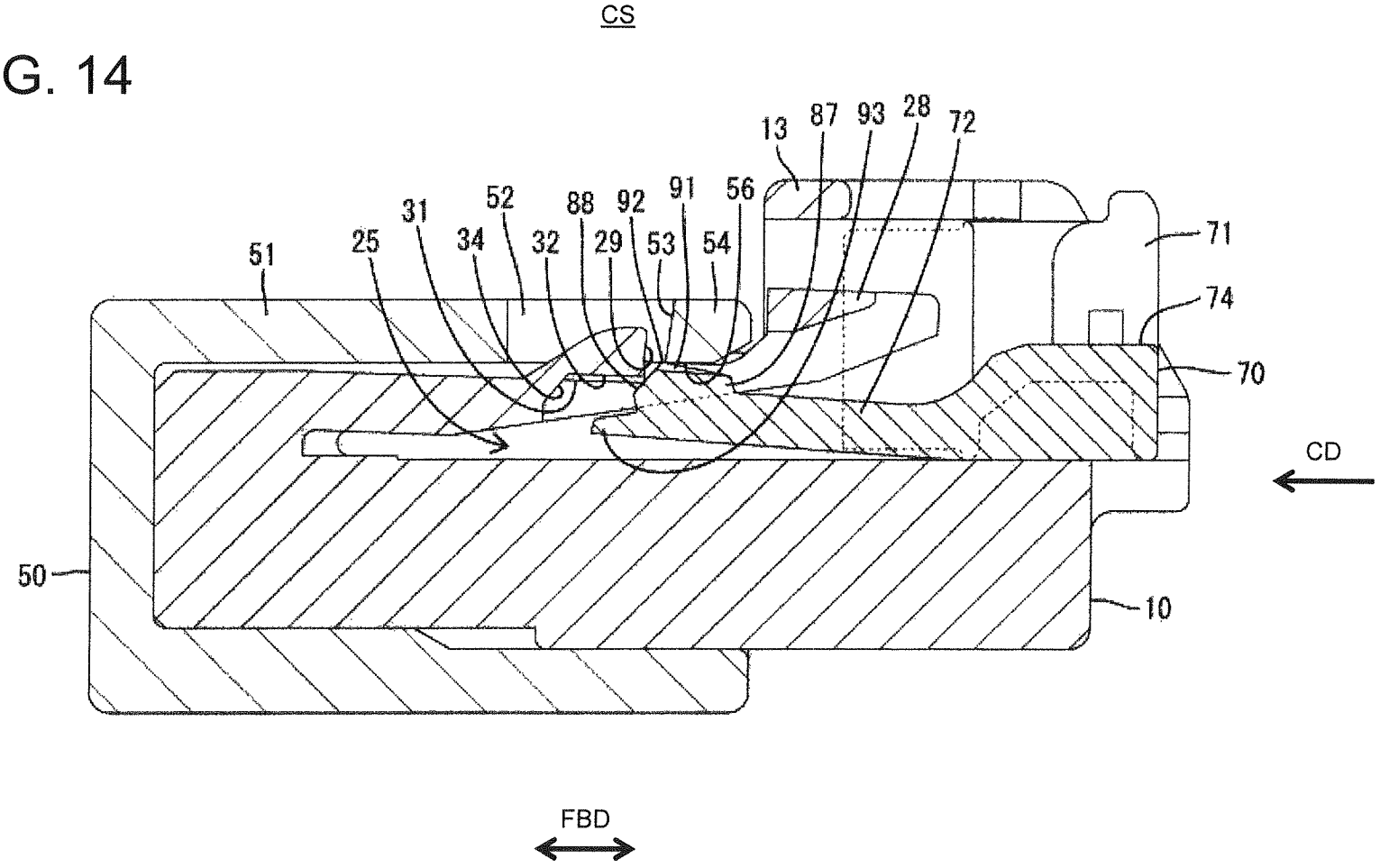
FIG. 14 is a section showing a state where a guide surface of the lock projection is held in sliding contact with an upper end opening edge of an accommodating recess in the process of moving the detecting member toward a detection position.

The protrusion 87 is a substantially rectangular block that projects up from a position near a front end of the resilient arm 72, as shown in FIG. 8. A tapered guide surface 88 is formed on an upper front part of the protrusion 87 and inclines up toward the back. The guide surface 88 of the protrusion 87 faces an upper opening edge of the accommodating recess 31 on the rear of the lock projection 24 when the detector 70 is at the standby position SP, as shown in FIG. 13. The guide surface 88 of the protrusion 87 slides on the upper opening edge of the accommodating recess as the detector 70 is moved from the standby position SP to the detection position DP, as shown in FIG. 14, and, accordingly, the resilient arm 72 inclines. The protrusion 87 then enters the accommodating recess 31 when the detector 70 reaches the detection position DP, as shown in FIG. 15. A tapered guided surface 34 is formed on the inner surface of the accommodating recess 31 and faces the guide surface 88 of the protrusion 87 at the detection position DP.

An auxiliary protrusion 91 projects on a widthwise central part of the upper surface of the protrusion 87 and forms a rib that extends in forward and backward directions FBD, as shown in FIGS. 8 and 9. A projecting distance of the auxiliary protrusion 91 is smaller than that of the protrusion 87. The auxiliary protrusion 91 fits into the auxiliary recess 32 when the protrusion 87 is inserted into the accommodating recess 31.

A tapered auxiliary guide surface 92 is formed at the front of the auxiliary protrusion 91 and inclines up and toward the back. The auxiliary guide surface 92 is substantially flush and continuous with the guide surface 88 and has substantially the same angle of inclination as the guide surface 88. The auxiliary guide surface 92 slides in contact with the upper opening edge of the accommodating recess 31, following the guide surface 88, as the detector 70 moves from the standby position SP to the detection position DP. Thus, the amount of resilient deformation of the resilient arm 72 is increased by the auxiliary protrusion 91. Note that an area of the upper surface of the auxiliary protrusion 91 behind the auxiliary guide surface 92 is tapered to incline down toward the back.

A contact portion 93 projects forward on a lower end part of the front end of the protrusion 87. As shown in FIG. 7, the contact portion 93 has a substantially rectangular plan view. The upper surface of the contact portion 93 is substantially horizontal and contacts the inner upper surface of the accommodating recess 31 from below when the detector 70 is at the initial position IP. In this way, the resilient arm 72 resiliently deforms slightly with a pre-load applied to the lock arm 12.

As shown in FIG. 8, a movement restricting surface 94 is formed between the guide surface 88 and the contact portion 93 on the front of the protrusion 87. The movement restricting surface 94 extends substantially in the height direction HD when the resilient arm 72 is in a natural state. Further, as shown in FIG. 11, the movement restricting surface 94 of the protrusion 87 faces the locking surface 29 of the lock projection 24 from behind when the detector 70 is at the initial position IP.

The detector 70 is inserted into the mount space 17 of the housing main body 11 from behind and along the inserting direction ID. The first shake preventing portions 82 slide in contact with the inner upper surfaces of the guide grooves 19 while being squeezed and the second shake preventing portions 83 slide in contact with the lower surface of the covering wall 16 while being squeezed, thereby ensuring a stable mounting posture of the detector 70 during the mounting process.

Figure 1:
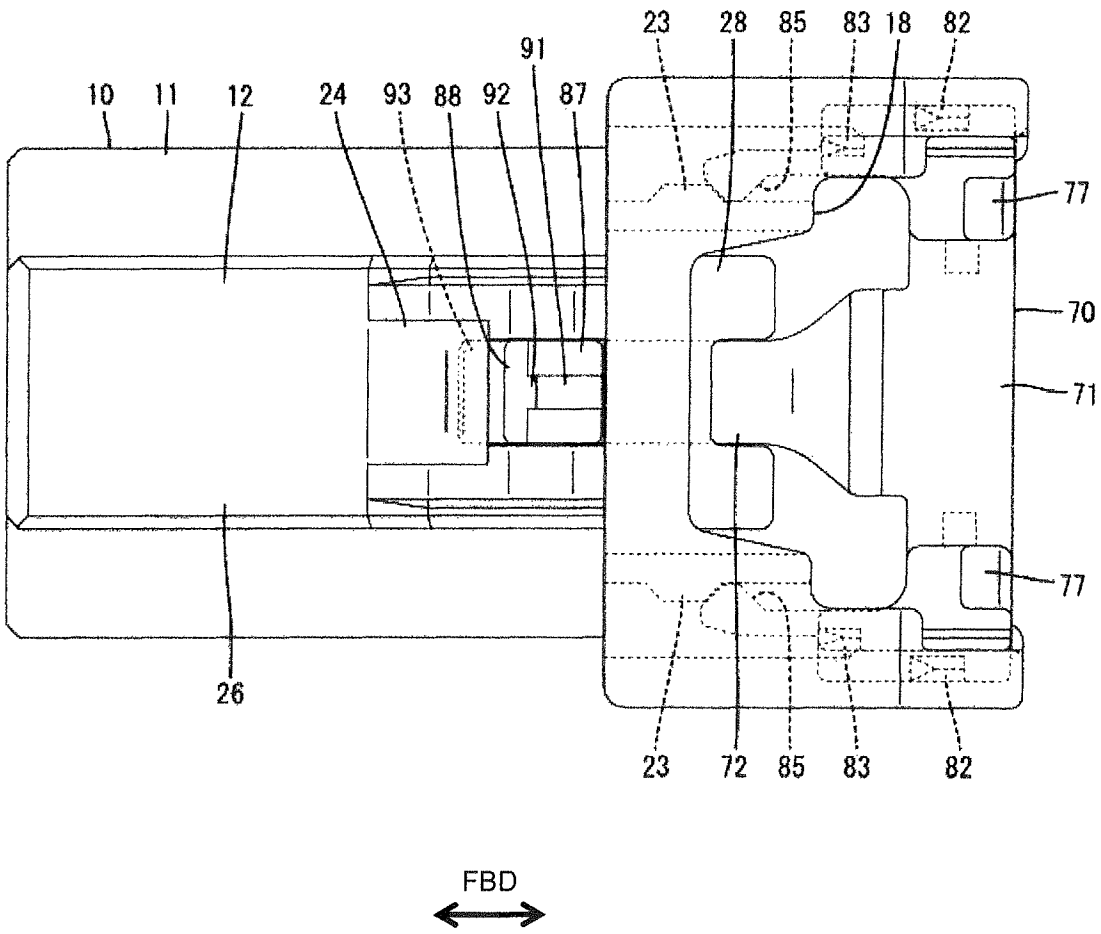
FIG. 1 is a plan view of a housing, on which a detecting member is mounted at an initial position, in a connector according to one embodiment of the present invention.

The resilient pieces 84 deform in the mounting process, but resiliently restore when the detector 70 reaches the initial position IP so that the second stops 86 engage the second retaining portions 22 from the front, as shown in FIG. 16. Simultaneously, the first stops 79 engage the first retaining portions 21 from front. Thus, the detector 70 cannot be detached backward from the housing main body 11. Further, the movement restricting surface 94 of the protrusion 87 engages the locking surface 29 of the lock projection 24 from behind when the detector 70 reaches the initial position IP, as shown in FIG. 11. The contact of the movement restricting surface 94 with the locking surface 29 prevents forward movement of the detector 70 along the inserting direction ID from the initial position IP. The contact of the partial locking portions 85 with the restricting portions 23 from behind, as shown in FIG. 17, further prevents forward movement of the detector 70 at the initial position IP. In this way, as shown in FIG. 1, the detector 70 is held in the housing main body 11 at the initial position IP with forward and backward movements prevented.

The contact portion 93 of the resilient arm 72 contacts the inner upper surface of the accommodating recess 31 at the initial position IP, as shown in FIG. 11, and the resilient arm 72 is held with respect to the lock arm 12 while accumulating a resilient force. Then, the contact portion 93 contacts the inner upper surface of the accommodating recess 31, so that an overlap margin between the movement restricting surface 94 of the protrusion 87 and the locking surface 29 of the lock projection 24 is determined automatically at a specified value.

The housing main body 11 then is fit into the receptacle 51 of the mating housing 50. The lock projection 24 initially slides in contact with the inclined surface 55 of the interfering portion 54 during the fitting process and then is pressed by the pressing surface 56 of the interfering portion 54. Thus, the lock arm 12 deforms into the deformation space 25, as shown in FIG. 12. The lock projection 24 moves beyond the interfering portion 54 when the housing main body 11 is connected properly to the mating housing 50. Thus, the lock arm 12 resiliently restores and the lock projection 24 enters the lock receiving portion 52 from below, as shown in FIG. 13. In this way, an upper part of the locking surface 29 of the lock projection 24 engages the engaging surface 53 of the lock receiving portion 52 to hold the two housings 10, 50 in the connected state.

Further, the auxiliary protrusion 91 on the upper end surface of the protrusion 87 is pressed down by the pressing surface 56 of the interfering portion 54, as shown in FIG. 13, when the housing main body 11 is connected properly to the mating housing 50. At this time, the protrusion 87 is kept in contact with the interfering portion 54 without following reciprocal displacements of the lock arm 12, and the contact portion 93 exits the accommodating recess 31. In this way, the detector 70 is kept at the standby position SP where the resilient arm 72 is separated from the lock arm 12 and held in contact with the mating housing 50. At the standby position SP, the resilient arm 72 is deformed by the interfering portion 54 and takes an inclined posture that is nearly horizontal.

Further, at the standby position SP, the guide surface 88 of the protrusion 87 faces the upper opening edge of the accommodating recess 31 on the rear of the lock projection 24 from behind while forming a small clearance, as shown in FIG. 13. That is, the upper opening edge of the accommodating recess 31 is accommodated within the height range of the guide surface 88 of the protrusion 87.

Subsequently, the rear surface of the rear portion 73 is pushed forward in the inserting direction ID to bring the detector 70 to the detection position DP. A pushing force on the detector 70 at the standby position SP releases a semi-locking state between the partial locking portions 85 and the restricting portions 23, and the resilient pieces 84 deform to move onto the restricting portions 23. Further, the guide surface 88 of the protrusion 87 and the auxiliary guide surface 92 of the auxiliary protrusion 91 successively come into sliding contact with the upper opening edge of the accommodating recess 31 during the movement toward the detection position DP, as shown in FIG. 14. As a result, the resilient arm 72 is deformed more and enters deeper into the deformation space 25 while the protrusion 87 is inserted into the accommodating recess 31 from behind.

The protrusion 87 is fit substantially entirely into the accommodating recess 31 and the auxiliary protrusion 91 is fit into the auxiliary recess 32 when the detector 70 reaches the detection position DP, as shown in FIG. 15. The protrusion 87 contacts the inner front surface of the accommodating recess 31 to prevent any further forward movement of the detector 70. Further, the resilient pieces 84 resiliently restore and the partial locking portions 85 contact the restricting portions 23 from the front, as shown in FIG. 18, to prevent a backward movement of the detector 70 from the detection position DP.

Figure 20:
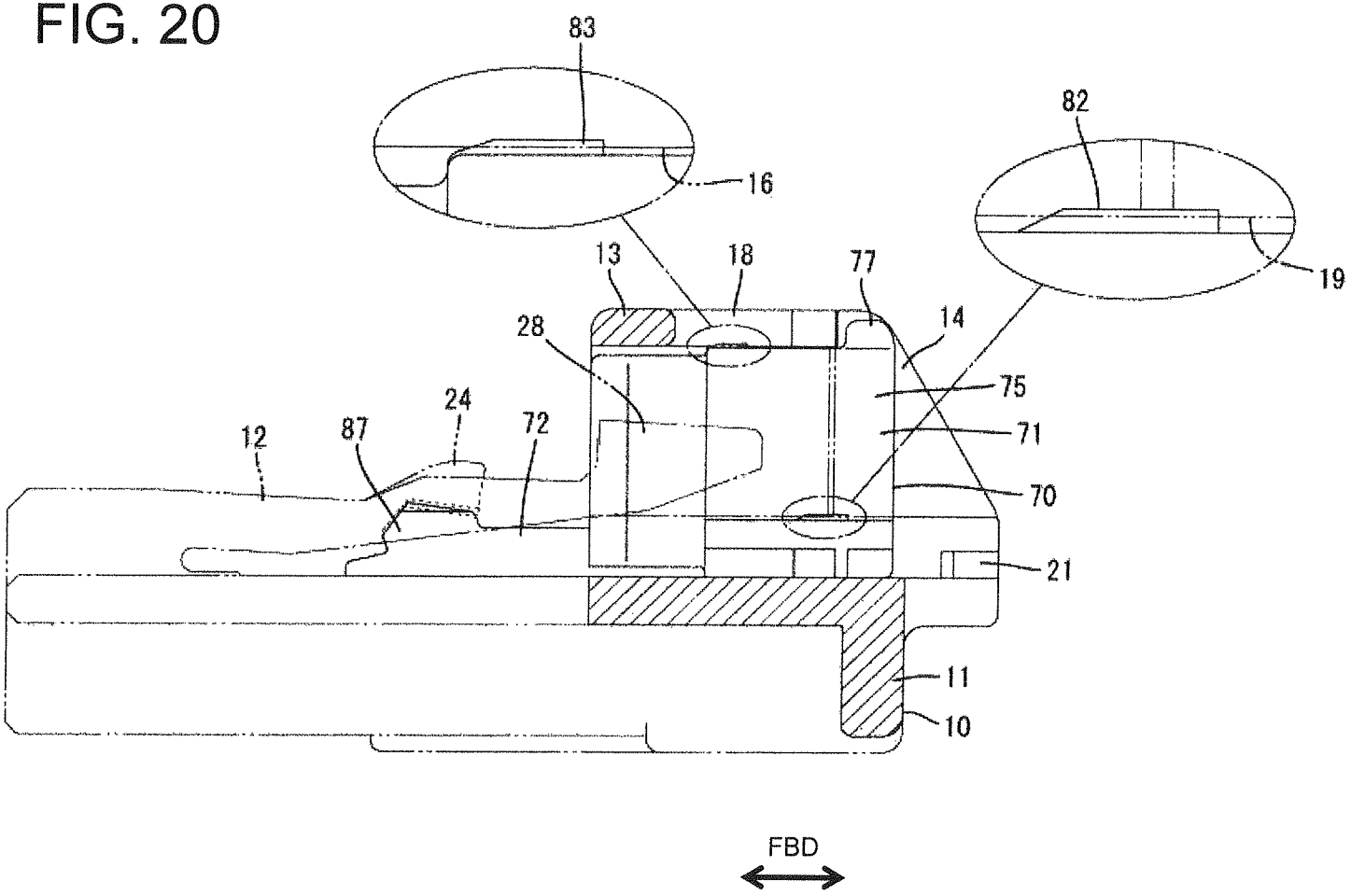
FIG. 20 is a side view with an essential part in section showing a state where the detecting member is mounted on the housing main body and the shake of a main portion is suppressed by first and second shake preventing portions.

The resilient arm 72 is held in a substantially horizontal posture at the detection position DP with a resilient force accumulated between the lock arm 12 and the housing main body 11, as shown in FIG. 15. The resilient arm 72 is inserted to a proper depth into the deformation space 25, thereby restricting resilient deformation of the lock arm 12 so that the two housings 10, 50 are held strongly in the connected state. The first shake preventing portions 82 are squeezed in sliding in contact with the inner upper surfaces of the guide grooves 19 and the second shake preventing portions 83 are squeezed in sliding contact with the lower surface of the covering wall 16 while moving the detector 70 from the initial position IP to the detection position DP via the standby position SP, thereby preventing inclination of the main portion 71 and ensuring stable movement of the detector 70. Further, the first and second shake preventing portions 82, 83 suppress shaking at each of the initial position IP, the standby position SP and the detection position DP, and the detector 70 is held on the housing main body 11 as shown in FIGS. 2 and 20.

The housing main body 11 might be kept at a partially connected position without being connected properly to the mating housing 50. Thus, the lock arm 12 is pressed by the pressing surface 56 of the interfering portion 54 and remains deformed in the deformation space 25, as shown in FIG. 12. An attempt may be made to push the detector 70 forward in the inserting direction ID in this state. However, the protrusion 87 will interfere with the lock projection 24 to prevent the resilient arm 72 from entering the deformation space 25 so that the detector 70 cannot move to the detection position DP. Thus, whether the housing main body 11 has been connected properly to the mating housing 50 can be detected based on whether the detector 70 is movable to the detection position DP.

The catches 77 are caught by fingers or a jig and the detector 70 is pulled back to separate the housings 10, 50. A backward pulling force on the detector 70 deforms the resilient pieces 84 so that the partial locking portions 85 disengage from the restricting portions 23. The detector 70 then is pulled back to the initial position IP. Subsequently, the fingers or the jig are inserted into the disengagement window 74 and press the disengaging portion 28 down. In this way, the lock projection 24 is separated from the lock receiving portion 52 and the lock arm 12 and the lock receiving portion 52 disengage. The housing main body 11 then is pulled apart from the mating housing 50 with the disengaging portion 28 pressed down so that the two housings 10, 50 can be separated from each other. The covering wall 16 is above the disengaging portion 28 and the cut portion 18 does not have a sufficient opening area to allow the entrance of the fingers or the jig.

The resilient arm 72 contacts the lock arm 12 in the height direction HD to apply a pre-load when the detector 70 is at the initial position IP. Accordingly, the resilient arm 72 is at a position to contact the lock arm 12 from behind and an overlap margin with the lock arm 12 is properly determined. Thus, detection reliability is very good even if dimensions of the detector 70 are not managed strictly.

The protrusion 87 of the resilient arm 72 overlaps the lock arm 12 along the deforming direction DD (in the height direction HD) when the detector 70 is at the standby position SP, and the guide surface 88 of the protrusion 87 slides contact with the lock arm 12 during movement to the detection position DP. Thus, the precision of position accuracy of the protrusion 87 at the standby position SP is required. However, the resilient arm 72 contacts the lock arm 12 in the height direction HD at the initial position IP. Therefore, position accuracy of the protrusion 87 advantageously can be satisfied.

The main portion 71 of the detector 70 is pressed to slide the detector 70 to the detection position DP. Shake preventing portions 82, 83 are provided on a slide-contact surface of the main portion 71 and are squeezed against a slide-contact surface of the housing main body 11 in the height direction HD while moving the detector 70. Thus, the detector 70 will not shake in the height direction HD and detection reliability of the detector 70 is good.

The first and second shake preventing portions 82, 83 are arranged two side by side in forward and backward directions FBD and in the height direction HD. Thus, the detector 70 will not incline in forward and backward directions FBD and a stable posture of the detector 70 is ensured.

The protrusion 87 is in the accommodating recess 31 of the lock arm 12 when the detector 70 reaches the detection position DP. Thus, the lock arm 12 and the detector 70 overlap along the height direction HD and the height of the connector can be reduced. The accommodating recess 31 is open toward the deformation space 25 of the lock arm 12 and toward the back, but not open on the front end connected to the housing main body 11. Therefore, the strength of the lock arm 12 is not reduced, and locking reliability is good.

The lock projection 24 projects along the deforming direction DD on the lock arm 12 and the accommodating recess 31 is open on the rear surface of the lock projection 24. Thus, a large opening area of the accommodating recess 31 is ensured along the deforming direction DD and within the height range of the lock projection 24.

The protrusion 87 and the lock projection 24 overlap along the deforming direction DD when the detector 70 is at the standby position SP. Thus, the corresponding height dimension of the connector can be further reduced.

The guide surface 88 of the protrusion 87 slides in contact with the upper end opening edge of the accommodating recess 31 to guide the protrusion 87 into the accommodating recess 31 as the detector 70 is moved from the standby position SP to the detection position DP. Thus, the detector 70 is moved stably.

The auxiliary protrusion 91 projects in the deforming direction DD on the upper end of the protrusion 87. The auxiliary guide surface 92 is continuous with the guide surface 88 and is formed on the front surface of the auxiliary protrusion 91. Thus, a large guide area is ensured in the deforming direction DD and dimensional management to have the protrusion 87 face the opening edge of the accommodating recess 31 at the standby position SP is facilitated. Further, the protrusion 87 and the auxiliary protrusion 91 are inserted into the accommodating recess 31 and the depth of the accommodating recess 31 is increased by the height of the auxiliary protrusion 91. However, the strength of the lock arm 12 is not reduced because a part of the inner upper surface of the accommodating recess 31 is recessed to form the auxiliary recess into which the auxiliary protrusion 91 is fit at the detection position DP. Thus, the depth of the entire accommodating recess 31 is not increased and a reduction in the strength of the lock arm 12 is avoided.

The protection wall 13 covers the surface of the disengaging portion 28 opposite the surface facing the deformation space 25 to prevent inadvertent operation of the disengaging portion 28. The disengaging portion 28 is operated by placing fingers or the jig through the disengagement window 74 at the rear portion 73 of the detector 70 when disengaging the lock arm 12. Thus, the lock arm 12 easily can be unlocked.

The catches 77 of the rear portion 73 can be caught with fingers or the jig to pull the detector 70 back to the initial position IP so that the disengaging portion 28 can be operated for separating the mating housing 50 from the housing main body 11. The catches 77 are at the opposite sides of the disengagement window 74 on the rear portion 73. Thus, space efficiency of the rear portion 73 is improved and the connector can be miniaturized.

The invention is not limited to the above described embodiment. For example, the following embodiments are also included in the scope of the invention.

The detecting member may be configured to be unable to restrict the resilient deformation of the lock arm when the detecting member reaches the detection position.

The accommodating recess may not be dimensioned and shaped so that the protrusion can fit therein and may be dimensioned so that the protrusion is fit loosely therein.

The accommodating recess may be open backward on a part of the lock arm other than the lock projection.

The shake preventing portions may be formed on the housing main body instead of or in addition to being formed on the main portion.

Two or more shake preventing portions may be arranged substantially side by side in forward and backward directions FBD and/or the height direction HD.

A plurality of auxiliary protrusions may be formed on the upper end of the protrusion. For example, a pair of auxiliary protrusions may be formed on opposite widthwise sides of the upper end of the protrusion. In this case, a plurality of auxiliary recesses may be formed at positions of the accommodating recess corresponding to the auxiliary protrusions.

The guide surface and the guide inclined surface may be curved.

What is claimed is:

1. A connector assembly comprising:

a connector having a housing and a housing main body;

a lock arm projecting from the housing main body, the lock arm being resiliently deformable in a deforming direction;

a detector to be mounted on the housing main body movably in a moving direction from an initial position to a detection position, the detector including a main portion and a resilient arm that is extending from the main portion and being resiliently deformable in the deforming direction, a protrusion projecting from an upper surface of a front end of the resilient arm in the deforming direction, a movement restricting surface formed on a front end of the protrusion, the movement restricting surface extending transverse to the moving direction and substantially parallel to the deforming direction, and a contact portion projecting forward from a lower surface of the protrusion; and a mating connector having a mating housing connectable with the housing, the mating housing having a lock receiving portion engageable with the lock arm to lock the housings in the connected state, wherein the movement restricting surface of the resilient arm contacts the lock arm before the housing main body is connected to the main housing to restrict an insertion movement of the detector at the initial position and the contact portion of the resilient arm is held in contact with the lock arm in the deforming direction at the initial position to apply a pre-load to the lock arm; and the resilient arm is displaced from the initial position and enters a deformation space for the lock arm with the protrusion engaging a surface of the lock arm facing the deformation space and with a surface of the resilient arm opposite the protrusion substantially engaging the housing main body to restrict deformation of the lock arm when the housing main body is connected properly to the mating housing.

2. A connector, comprising:

a housing main body to be connected to a mating housing;

a lock arm projecting from the housing main body, the lock arm being resiliently deformable in a deforming direction and being resiliently engageable with a lock receiving portion of the mating housing to hold the housing main body and the mating housing in a connected state; and a detector to be mounted on or to the housing main body movably in a moving direction from an initial position to a detection position, the detector including a main portion and a resilient arm that is extending from the main portion and being resiliently deformable in the deforming direction, a protrusion projecting from an upper surface of a front end of the resilient arm in the deforming direction, a movement restricting surface formed on a front end of the protrusion, the movement restricting surface extending transverse to the moving direction and substantially parallel to the deforming direction, and a contact portion projecting forward from a lower surface of the protrusion, and the resilient arm being configured such that:

the movement restricting surface of the resilient arm contacts the lock arm before the housing main body is connected to the mating housing to define a movement restricted state where movement of the detector is restricted and with the contact portion of the resilient arm held in contact with the lock arm in the deforming direction to apply a pre-load to the lock arm, and the movement restricted state is released when the housing main body is connected properly to the mating housing so that the detector is movable to the detection position where the resilient arm enters a deformation space for the lock arm with the protrusion engaging a surface of the lock arm facing the deformation space and with a surface of the resilient arm opposite the protrusion substantially engaging the housing main body to restrict deformation of the lock arm when the housing main body is connected properly to the mating housing.

3. The connector of claim 2, wherein the resilient arm is cantilevered.

4. The connector of claim 2, wherein:

the detector moves from the initial position towards the detection position via a standby position where the movement restricted state is released by contact with the mating housing; and the protrusion at least partly overlaps the lock arm in the deforming direction when the detector is at the standby position.

5. The connector of claim 2, wherein:

the resilient arm is coupled to the main portion and is resiliently deformable with a coupled position thereof as a support; and the main portion slides in contact with the housing main body when moving the detector.

6. The connector of claim 5, further comprising at least one shake preventing portion on at least one of slide-contact surfaces of the main portion and the housing main body and squeezable against the other slide-contact surface during movement toward the detection position.

7. The connector of claim 6, wherein the at least one shake preventing portion comprises a plurality of shake preventing portions arranged substantially side by side in forward and backward directions or in the deforming direction on the main portion.

* * * * *